US009759028B2

(12) United States Patent
Herrera

(10) Patent No.: US 9,759,028 B2
(45) Date of Patent: Sep. 12, 2017

(54) DOWNHOLE ANCHOR TOOL

(71) Applicant: Halliburton Energy Services, Inc., Houston, TX (US)

(72) Inventor: Adan Hernandez Herrera, Humble, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/760,360

(22) PCT Filed: Aug. 21, 2014

(86) PCT No.: PCT/US2014/052093

§ 371 (c)(1),
(2) Date: Jul. 10, 2015

(87) PCT Pub. No.: WO2016/028299

PCT Pub. Date: Feb. 25, 2016

(65) Prior Publication Data

US 2016/0290080 A1 Oct. 6, 2016

(51) Int. Cl.
*E21B 23/01* (2006.01)

(52) U.S. Cl.
CPC ..... *E21B 23/01* (2013.01)

(58) Field of Classification Search
CPC ..... E21B 23/01
USPC ..... 166/382
See application file for complete search history.

(56) References Cited

U.S. PATENT DOCUMENTS

| | | | | |
|---|---|---|---|---|
| 4,184,546 | A * | 1/1980 | Nicolas | E21B 23/01 166/206 |
| 4,369,840 | A | 1/1983 | Szarka et al. | |
| 4,616,703 | A | 10/1986 | Laurent et al. | |
| 5,475,187 | A | 12/1995 | Omnes | |
| 6,796,380 | B2 | 9/2004 | Xu | |
| 6,910,533 | B2 | 6/2005 | Guerrero | |
| 6,920,936 | B2 | 7/2005 | Sheiretov et al. | |
| 7,222,682 | B2 | 5/2007 | Doering et al. | |
| 7,252,143 | B2 | 8/2007 | Sellers et al. | |
| 7,331,386 | B2 | 2/2008 | Kanayama et al. | |
| 7,748,476 | B2 | 7/2010 | Krueger, V | |
| 8,151,902 | B2 | 4/2012 | Lynde et al. | |
| 8,291,781 | B2 | 10/2012 | Guerrero et al. | |
| 8,555,986 | B2 | 10/2013 | Clemens et al. | |

(Continued)

FOREIGN PATENT DOCUMENTS

| | | | |
|---|---|---|---|
| FR | 1468914 | A | 1/1967 |
| WO | 2012091838 | A2 | 7/2012 |

OTHER PUBLICATIONS

International Searching Authority, International Search Report and Written Opinion, International No. PCT/US2014/052093, which is a PCT parent to the instant application, May 19, 2015.

*Primary Examiner* — Taras P Bemko

(74) *Attorney, Agent, or Firm* — Howard L. Speight, PLLC

(57) ABSTRACT

A first lobe is fixedly coupled to a wall of a housing. A fixed pivot is fixedly coupled to the first lobe and to the wall of the housing. A chamber pivot is rotatably coupled to the first lobe. A floating pivot is rotatably coupled to the chamber pivot. A first link is rotatably coupled to the floating pivot. A slip pivot is rotatably coupled to the first link. A second link is rotatably coupled to the slip pivot and to the fixed pivot. A pad is coupled to the slip pivot. An actuator is coupled to the first lobe and to the second lobe.

8 Claims, 5 Drawing Sheets

(56) References Cited

U.S. PATENT DOCUMENTS

| | | | | |
|---|---|---|---|---|
| 8,585,110 | B2 | 11/2013 | Belik | |
| 2004/0031606 | A1* | 2/2004 | Xu | E21B 23/01 166/213 |
| 2005/0269073 | A1 | 12/2005 | Ruttley et al. | |
| 2007/0204987 | A1 | 9/2007 | Carro | |
| 2008/0149339 | A1* | 6/2008 | Krueger V | E21B 4/18 166/301 |
| 2011/0146970 | A1 | 6/2011 | Sommer | |
| 2013/0113227 | A1 | 5/2013 | Mitchell | |

* cited by examiner

DOWNHOLE ANCHOR TOOL

BACKGROUND

It can be useful to locate a tool in a well tubular, such as a well casing or a drill pipe, and anchor it in place so that it does not move within the well tubular. Once the tool is anchored, it can be used to free tools that are stuck in the borehole conduit, to free debris from the borehole conduit, or to perform other similar tasks.

DETAILED DESCRIPTION

Figure 1:
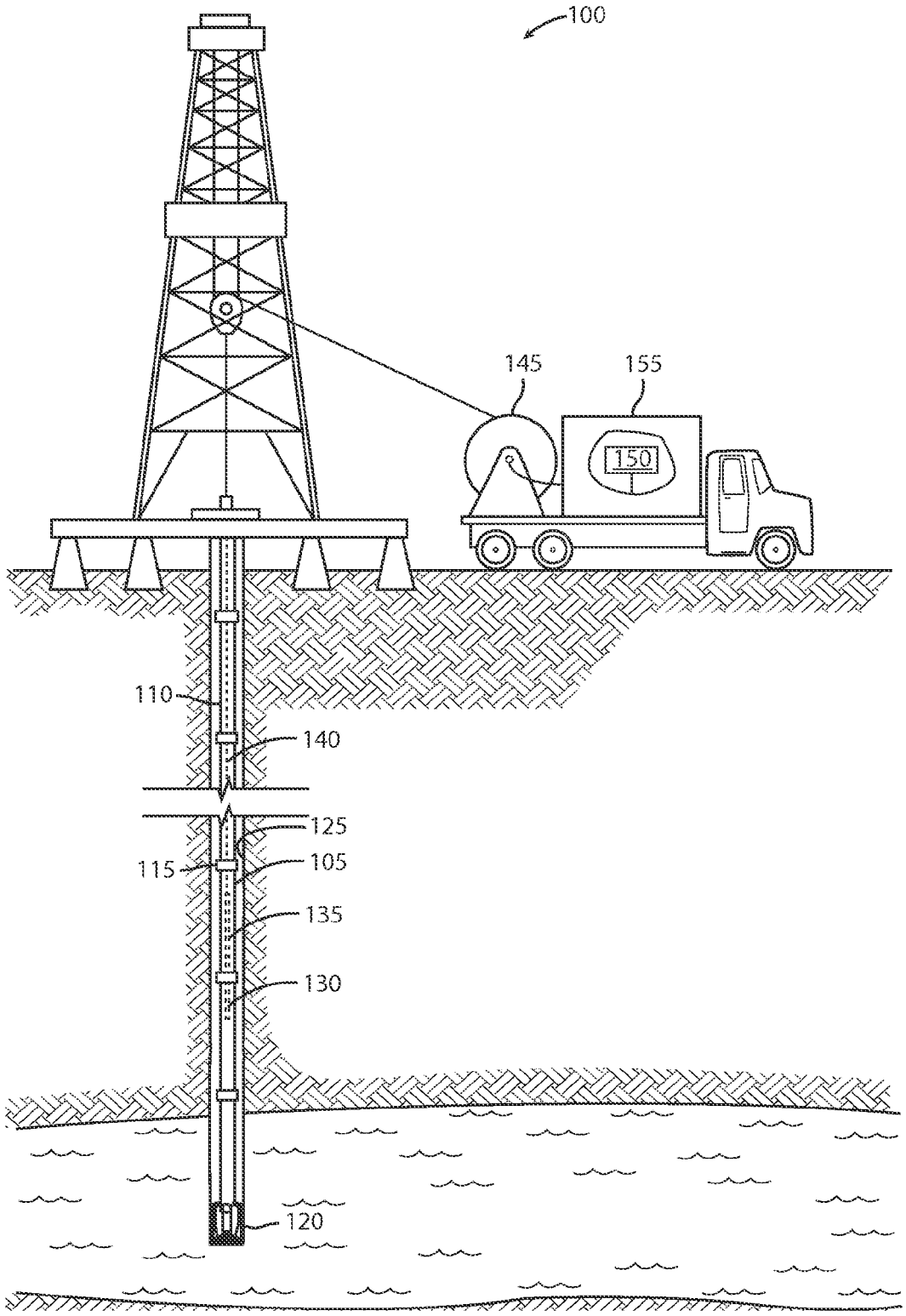
FIG. 1 is a schematic representation of a drill system showing an environment incorporating aspects of the present disclosure.

While this disclosure describes a land-based drilling system, it will be understood that the equipment and techniques described herein are applicable in sea-based systems, multilateral wells, all types of drilling systems, all types of rigs, measurement while drilling ("MWD")/logging while drilling ("LWD") environments, wired drillpipe environments, coiled tubing (wired and unwired) environments, wireline environments, and similar environments. An oil field system 100, such as a drilling system, a workover system, or a production system, illustrated in FIG. 1, may include a well tubular 105, such as casing, tubing, drill pipe or drill collars. The well tubular 105 may include joints of well tubular 110 (only one is labeled), coupled by connections 115 (only one is labeled). When the oil field system is a drilling system, a bit 120 may be located at the deepest end of the well tubular 105.

In one or more embodiments, such as in the example shown in FIG. 1, a work tool 130 and an anchor tool 135 have been lowered into the borehole by a cable 140 that passes through the well tubular 105, through a spool 145 that allows the work tool 130 and the anchor tool 135 to be raised and lowered within the borehole 125, and then to a control panel 150 (shown through a cutout) inside a truck 155. The control panel 150 may be used to control the work tool 130 and the anchor tool 135.

The work tool 130 may be any of a variety of tools, including a debris removal tool, a fishing tool, a jarring tool, and other similar tools. The anchor tool 135 may be included to anchor the work tool 130 in place in the borehole 125 while the work tool 130 performs its function.

Figure 2A:
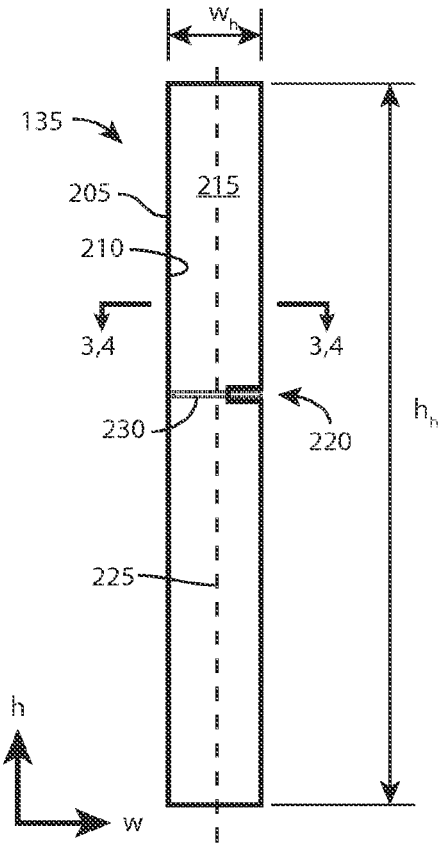
FIG. 2A is a plan view showing an anchor tool in accordance with aspects of the present disclosure.

One or more embodiments of the anchor tool 135, illustrated in FIG. 2A, includes a housing 205. In one or more embodiments, the housing 205 includes a columnar wall 210, a chamber within the wall 210, and a slot 220 through the wall 210. The housing 205 has a height $h_h$ along a height dimension (h) and a width $w_h$ along a width dimension (w), where $h_h > w_h$. In one or more embodiments, an axis 225 extends through the center of the housing 205 along the height dimension. The slot 220 has a longitudinal dimension substantially parallel to the axis 225 and a circumferential dimension around the circumference of the columnar wall 210. In one or more embodiments, the circumferential dimension of the slot 220 is greater than the longitudinal dimension of the slot 220.

Figure 2B:
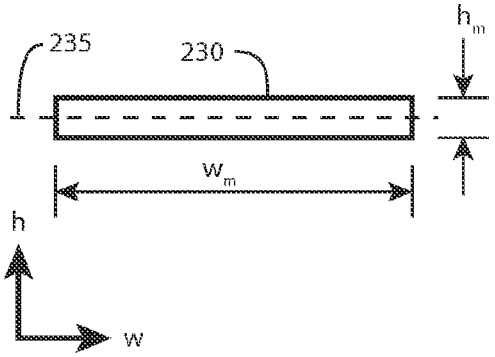
FIG. 2B is a plan view showing a mechanism in accordance with aspects of the present disclosure.

In one or more embodiments, a mechanism 230 is contained within the housing 205. In one or more embodiments, the mechanism 230 is aligned with the slot 220, illustrated in FIG. 2B, has height $h_m$ along the height dimension (h) and a width $w_m$ along the width dimension (w), where $w_m > h_m$. In one or more embodiments, the mechanism has an axis 235 that extends through the center of the mechanism 230 along the width dimension.

In one or more embodiments, the axis 235 of the mechanism 230 is substantially perpendicular to the axis 225 of the housing 135. "Substantially perpendicular" may mean within 5 degrees of perpendicular. "Substantially perpendicular" may mean within 10 degrees of perpendicular. "Substantially perpendicular" may mean within 20 degrees of perpendicular.

Figure 3:
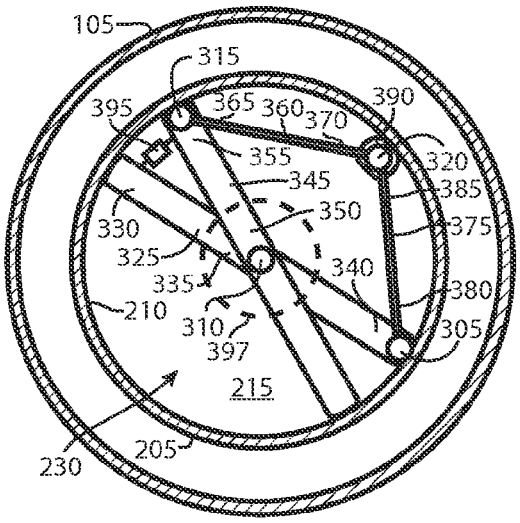
FIGS. 3-4 are cross-sectional views showing a mechanism in accordance with aspects of the present disclosure.
Figure 4:
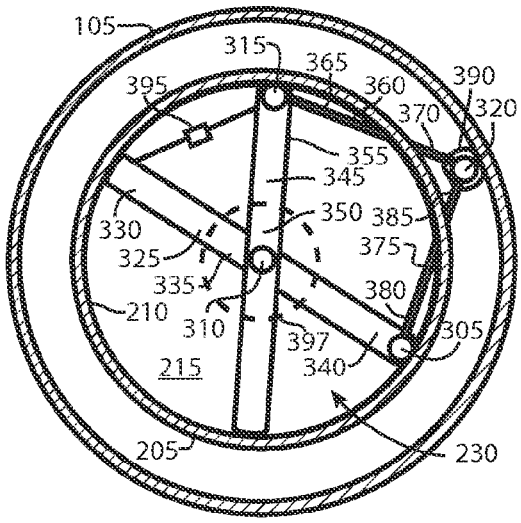

In one or more embodiments, the mechanism 230, illustrated in cross-section in FIGS. 3 and 4 includes a fixed pivot 305 coupled to the wall 210 of the housing 205. In one or more embodiments, the mechanism 230 also includes a chamber pivot 310 located in the chamber 215, a floating pivot 315, and a slip pivot 320.

In one or more embodiments, the mechanism 230 includes a fixed lobe 325. In one or more embodiments, the fixed lobe includes a housing end 330 coupled to the housing 205, a fixed center portion 335 coupled to the chamber pivot 310, and (optionally) a fixed end 340 coupled to the fixed pivot 305.

In one or more embodiments, the mechanism 230 further includes a floating lobe 345. In one or more embodiments, the floating lobe 345 includes a floating center portion 350 coupled to the chamber pivot 310 and a floating link end 355 coupled to the floating pivot 315.

In one or more embodiments, the mechanism 230 further includes a first link 360. In one or more embodiments, the first link 360 includes a floating end 365 coupled to the floating pivot 315 and a first pad end 370 coupled to the slip pivot 320.

In one or more embodiments, the mechanism 230 further includes a second link 375. In one or more embodiments, the second link 375 includes a fixed end 380 coupled to the fixed pivot 305 and a second pad end 385 coupled to the slip pivot 320.

In one or more embodiments, the mechanism 230 further includes a pad 390 coupled to the slip pivot 320 and extendable through the slot 220 in the wall 210 upon rotation of the floating lobe 345 with respect to the fixed lobe 325 about the chamber pivot 310.

In one or more embodiments, the mechanism 230 further includes an actuator for rotating the floating lobe 345 with respect to the fixed lobe 325 about the chamber pivot 310. In one or more embodiments, the actuator may include a piston 395 that extends between the floating lobe 345 and the fixed lobe 325. In one or more embodiments, the actuator may include a motor 397 (shown as a dashed line in FIGS. 3 and 4) coupled to the chamber pivot 310 instead of or in addition to the piston 395. In the latter case, in one or more embodiments, rotation of the motor 397 about the chamber pivot 310 produces a radial motion of the pad 390.

In one or more embodiments, such as that shown in FIGS. 2A, 2B, 3, and 4, the fixed lobe 325 does not move relative to the housing 205 during an actuation operation. In one or more embodiments, the floating lobe 345 rotates about the chamber pivot 310. In one or more embodiments, the floating pivot 315 rotates with respect to the floating link end 355 of the floating lobe 345. In one or more embodiments, the first link 360 rotates with respect to the floating pivot 315 and with respect to the slip pivot 320. In one or more embodiments, the second link 375 rotates with respect to the fixed pivot 305 and with respect to the slip pivot 320.

In one or more embodiments, the fixed pivot 305, chamber pivot 310, floating pivot 315, and slip pivot 320 may be hinges or they may be more other structures that allow the rotations described above.

FIG. 3 shows one or more embodiments of the mechanism 230 prior to actuation and FIG. 4 shows one or more embodiments of the mechanism 230 after actuation. In one or more embodiments, the mechanism 230 operates by activating the piston 395 or turning the motor 397, which can be done at the command of the control panel 150 or by a computer on the surface or in the borehole 125. In one or more embodiments, this causes the floating lobe 345 to rotate about the chamber pivot 310 relative to the fixed pivot 305. In one or more embodiments, the rotatable connection of the floating lobe 345 to the floating pivot 315, the rotatable connections of the first link 360 and the second link 375 to the slip pivot, and the rotatable connection of the second link 375 to the fixed pivot 305 create a scissor-action 4-bar linkage such that rotation of the floating lobe 345 causes the slip pivot 320 and the pad 390 to extend in an arc defined by the travel of the second link 375 about the fixed pivot 305. In one or more embodiments, the result, shown in FIG. 4, is the pad 390 being pressed against the well tubular 105, performing the desired anchoring action.

In one or more embodiments, the angle between the fixed lobe 325 and the floating lobe 345 at full extension, as shown in FIG. 4, depends on the relative dimensions of fixed lobe 325 and the floating lobe 345, which are constrained by the dimensions of the housing 205, as compared to the dimensions of the well tubular 105. These dimensions may be chosen so that the angle between the fixed lobe 325 and the floating lobe 345 at full extension, as shown in FIG. 4, is substantially 90 degrees, which is the point at which the pad 390 exerts the maximum force against the well tubular 105.

In one or more embodiments, orientation of the axis 235 of the mechanism 230 substantially perpendicular to the axis 235 of the housing provides a mechanism 230 that maintains the envelope of the outside diameter of the anchor tool 235 but has an improved engagement envelope. That is, in one or more embodiments, the angle between the fixed lobe 325 and the floating lobe 345 can approach 90 degrees with a relatively small travel of the pad 390.

Figure 5:
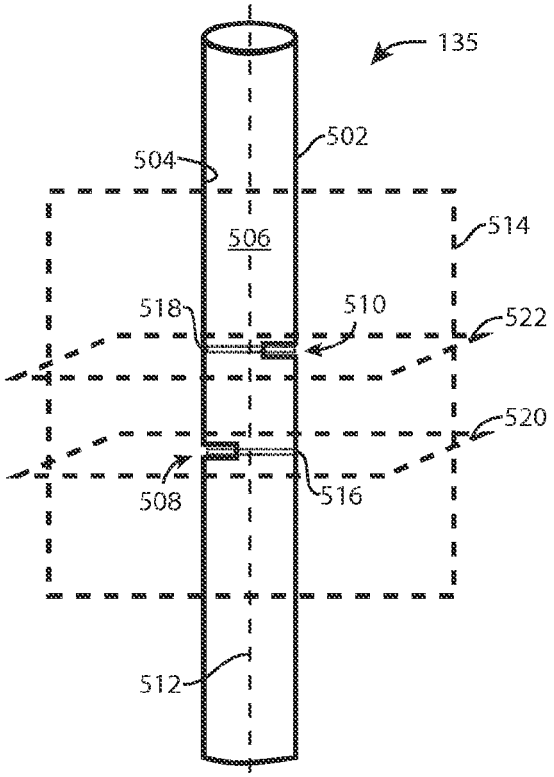
FIG. 5 is a perspective view showing an anchor tool in accordance with aspects of the present disclosure.

One or more embodiments of the anchor tool 135, illustrated in FIG. 5, include a housing 502. In one or more embodiments, the housing 502 includes a columnar wall 504, a chamber 506 within the wall 504, a plurality of slots 508, 510 through the wall, and a center axis 512 about which the columnar wall 504 is symmetrical. Each of the plurality of slots 508, 510 has a longitudinal dimension substantially parallel to the center axis 512 and a circumferential dimension around the circumference of the columnar wall 504. In one or more embodiments, the circumferential dimension of each of the plurality of longitudinally-separated slots 508, 510 is greater than the respective longitudinal dimension of each of the plurality of longitudinally-separated slots 508, 510.

In one or more embodiments, the housing 502 includes an axis plane 514 that contains the center axis 512. In one or more embodiments, the housing 502 includes a plurality of mechanisms 516, 518. Each of the plurality of mechanisms may be of the type illustrated in FIGS. 3 and 4. Each of the plurality of mechanisms may be aligned with a respective one of the plurality of slots; i.e., in FIG. 5, mechanism 516 is aligned with slot 508 and mechanism 518 is aligned with slot 510.

Each of the plurality of mechanisms 516, 518 may include a plurality of pivots, such as the fixed pivot 305, chamber pivot 310, floating pivot 315, and slip pivot 320 illustrated in FIGS. 3 and 4. Each of the plurality of mechanisms 516, 518 may have a respective mechanism plane 520, 522 that intersects at least 3 of the pivots of that mechanism. In one or more embodiments, the plurality of mechanism planes 520, 522 are substantially perpendicular to the axis plane 514, where "substantially perpendicular" has the meaning defined above.

Figure 6:
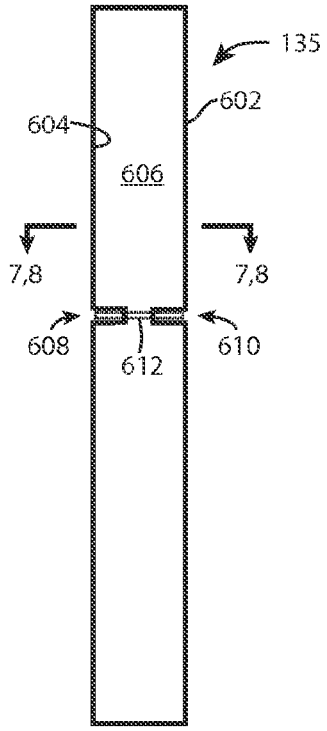
FIG. 6 is a plan view showing an anchor tools in accordance with aspects of the present disclosure.

One or more embodiments of the anchor tool 135, illustrated in FIG. 6, include a housing 602. In one or more embodiments, the housing 602 includes a columnar wall 604, a chamber 606 within the wall 604, a first slot 608 through the wall 604, and a second slot 610 through the wall 604. The first slot 608 and the second slot 610 have longitudinal dimensions. The first slot 608 and the second slot 610 have circumferential dimensions around the circumference of the columnar wall 604. In one or more embodiments, the circumferential dimension of first slot 608 is greater than the longitudinal dimension of the first slot 608. In one or more embodiments, the circumferential dimension of the second slot 610 is greater than the longitudinal dimension of the second slot 610.

In one or more embodiments, the housing includes a mechanism 612. In one or more embodiments, the mechanism 612, illustrated in FIGS. 7 and 8, includes a chamber pivot 702 located in the chamber 606. In one or more embodiments, the mechanism further includes a first pivot 704, a second pivot 706, a third pivot 708, a fourth pivot, 710, a first slip pivot 712, and a second slip pivot 714.

In one or more embodiments, the mechanism 612 further includes a first lobe 716. In one or more embodiments, the first lobe 716 includes a first-lobe-first-pivot end 718 coupled to the first pivot 704, a first-lobe-center portion 729 coupled to the chamber pivot 702, and a first-lobe-fourth pivot end 722 coupled to the fourth pivot 710.

In one or more embodiments, the mechanism 612 further includes a second lobe 724. In one or more embodiments, the second lobe 724 includes a second-lobe-second-pivot end 730 coupled to the second pivot 706, a second-lobe-center portion 728 coupled to the chamber pivot 702, and a second-lobe-third-pivot end 726 coupled to the third pivot 708.

In one or more embodiments, the mechanism 612 further includes a first link 732. In one or more embodiments, the first link 732 includes a first-link-third-pivot end 734 coupled to the third pivot 708 and a first pad end 736 coupled to the first slip pivot 712.

In one or more embodiments, the mechanism 612 further includes a second link 738. In one or more embodiments, the second link 738 includes a second-link-fourth-pivot end 740 coupled to the fourth pivot 710 and a second pad end 742 coupled to the first slip pivot 712.

In one or more embodiments, the mechanism 612 further includes a third link 744. In one or more embodiments, the third link includes a third-link-first-pivot end 746 coupled to the first pivot 704 and a third pad end 748 coupled to the second slip pivot 714.

In one or more embodiments, the mechanism 612 further includes a fourth link 750. In one or more embodiments, the fourth link 750 includes a fourth-link-second-pivot end 752 coupled to the second pivot 706 and a fourth pad end 754 coupled to the second slip pivot 714.

In one or more embodiments, the mechanism 612 further includes a first pad 756 coupled to the first slip pivot 712 and extendable through the first slot 608 in the wall 604 upon rotation of the first lobe 716 with respect to the second lobe 724 about the chamber pivot 702. In one or more embodiments, the mechanism 612 further includes a second pad 758 coupled to the second slip pivot 714 and extendable through the second slot 610 in the wall 604 upon rotation of the first lobe 716 with respect to the second lobe 724 about the chamber pivot 702.

In one or more embodiments, the mechanism 612 further includes an actuator for rotating the first lobe with respect to the second lobe about the chamber pivot. In one or more embodiments, the actuator may include a piston 760 that extends between the first lobe 716 and the second lobe 724. The actuator may include a motor 762 (shown as a dashed line in FIGS. 7 and 8) coupled to the chamber pivot 702.

Figure 7:
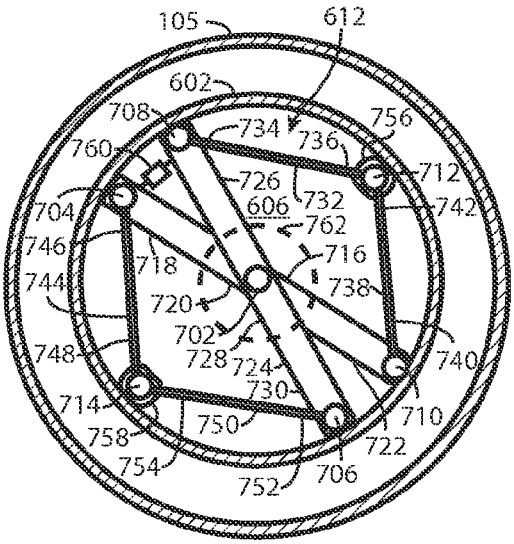
FIGS. 7-8 are cross-sectional views showing a mechanism in accordance with aspects of the present disclosure.
Figure 8:
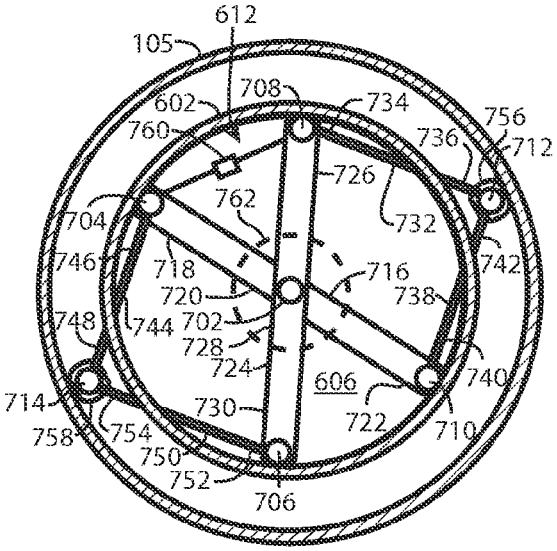

In one or more embodiments, such as those shown in FIGS. 7 and 8, the first lobe 716 rotates with respect to the second lobe 724. In one or more embodiments, both the first lobe 716 and the second lobe 724 move with respect to the housing 602. In one or more embodiments, the first lobe 716 rotates about the chamber pivot 702. The second lobe 724 rotates about the chamber pivot 702. The first pivot 704 rotates with respect to the first-lobe-first-pivot end 718 of the first lobe 716. In one or more embodiments, the second pivot 706 rotates with respect to the second-lobe-third-pivot end 730 of the second lobe 724. The third pivot 708 rotates with respect to the second-lobe-second-pivot end 726 of the second lobe 724. In one or more embodiments, the fourth pivot 710 rotates with respect to the first-lobe-fourth-pivot end 722 of the first lobe 716. The first link 732 rotates with respect to the third pivot 708 and the first slip pivot 712. In one or more embodiments, the second link 738 rotates with respect to the first slip pivot 712 and the fourth pivot 710. In one or more embodiments, the third link 744 rotates with respect to the first pivot 704 and the second slip pivot 714. In one or more embodiments, the fourth link 750 rotates with respect to the second slip pivot 714 and the second pivot 706.

In one or more embodiments, the chamber pivot 702, first pivot 704, second pivot 706, third pivot 708, fourth pivot 710, first slip pivot 712, and second slip pivot 714 may be hinges or different structures that allow the rotations described above.

FIG. 7 shows the mechanism 612 in one or more embodiments prior to actuation and FIG. 8 shows the mechanism 612 in one or more embodiments after actuation. In one or more embodiments, the mechanism 612 operates by activating the piston 760 or turning the motor 762, which can be done at the command of the control panel 150 or by a computer on the surface or in the borehole 125. In one or more embodiments, this causes the first lobe 716 to rotate with respect to the second lobe 724. In one or more embodiments, the rotatable connection of the first lobe 716 to the chamber pivot 702 and the first pivot 704, the rotatable connection of the third link 744 to the first pivot 704 and the second slip pivot 714, and the rotatable connection of the fourth link to the second slip pivot 714 and the second pivot 706 create a scissor-action 4-bar linkage such that rotation of the first lobe 716 and the set second lobe 724 with respect to each other causes the slip pivot 714 and the second pad 758 to extend through the second slot 610 to engage the well tubular 105. Similarly, in one or more embodiments, the rotatable connection of the second lobe 724 to the chamber pivot 702 and to the third pivot 708, the rotatable connection of the first link 732 to the third pivot 708 and to the first slip pivot 712, and the rotatable connection of the second link 738 to the first slip pivot 712 and to the fourth pivot 710 create a scissor-action 4-bar linkage such that rotation of the first lobe 716 and the second lobe 724 with respect to each other causes the first slip pivot 712 and the first pad 756 to extend through the first slot 608 and engage the well tubular 105, as shown in FIG. 8.

Figure 9:
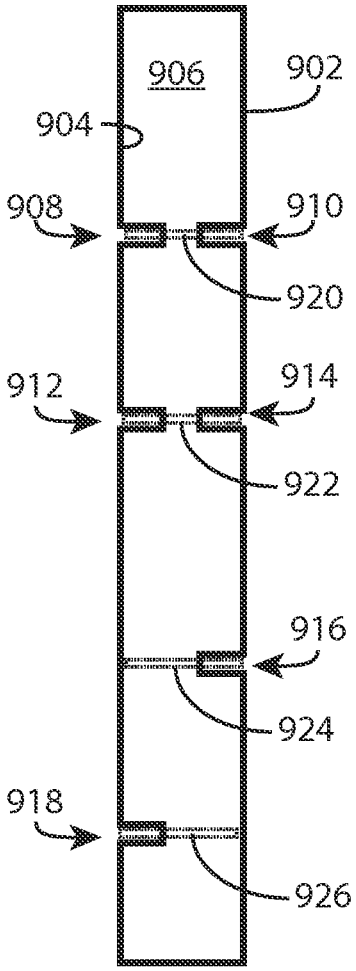
FIG. 9 is a plan view show a mechanism in accordance with aspects of the present disclosure.

One or more embodiments of the anchor tool 135, illustrated in FIG. 9, include a housing 902. The housing 902 includes a columnar wall 904, a chamber 906 within the wall 904, and a plurality of slots 908, 910, 912, 914, 916, 918 through the wall 904. In one or more embodiments, the housing 902 contains mechanisms 920, 922 of the sort illustrated in FIGS. 7 and 8 and mechanisms 924, 926 of the sort illustrated in FIGS. 3 and 4. Each of the plurality of slots 908, 910, 912, 914, 916, 918 has a longitudinal dimension. Each of the plurality of slots 908, 910, 912, 914, 916, 918 has a circumferential dimension around the circumference of the columnar wall 904. In one or more embodiments, the circumferential dimension of each of the plurality of slots 908, 910, 912, 914, 916, 918 is greater than the respective longitudinal dimension of each of the plurality of slots 908, 910, 912, 914, 916, 918.

In one or more embodiments, the mechanisms 230, 516, 518, 612, 920, 922, 924, 926 may have additional lobes so that they are similar to the multi-lobed structure of a scissor lift.

Figure 10:
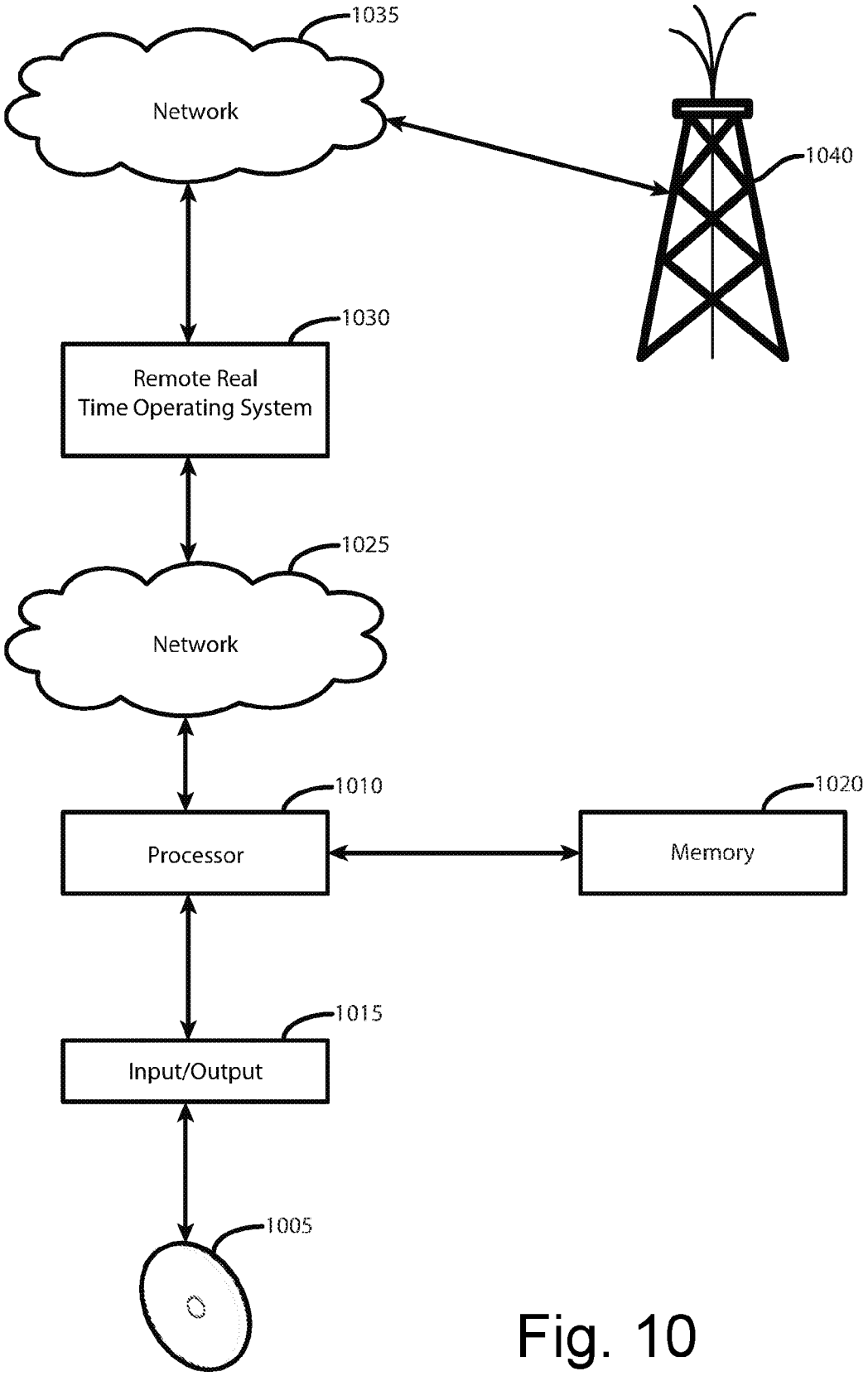
FIG. 10 is a block diagram showing an environment according to aspects of the present disclosure.

In one or more embodiments, shown in FIG. 10, the anchor tool 135 is controlled by software in the form of a computer program on a non-transitory computer readable media 1005, such as a CD, a DVD, a USB drive, a portable hard drive or other portable memory. In one or more embodiments, a processor 1010, which may be the same as or included in the control panel 150, reads the computer program from the computer readable media 1005 through an input/output device 1015 and stores it in a memory 1020 where it is prepared for execution through compiling and linking, if necessary, and then executed. In one or more embodiments, the system accepts inputs through an input/output device 1015, such as a keyboard or keypad, mouse, touchpad, touch screen, etc., and provides outputs through an input/output device 1015, such as a monitor or printer. In one or more embodiments, the system stores the results of calculations in memory 1020 or modifies such calculations that already exist in memory 1020.

In one or more embodiments, the results of calculations that reside in memory 1020 are made available through a network 1025 to a remote real time operating center 1030. In one or more embodiments, the remote real time operating center 1030 makes the results of calculations available through a network 1035 to help in the planning of oil wells 1040 or in the drilling of oil wells 1040.

An apparatus includes a housing. The housing includes a columnar wall, a chamber within the wall, and a slot through the wall. The apparatus further includes a mechanism within the housing. The mechanism includes a fixed pivot coupled to the wall of the housing. The mechanism further includes a chamber pivot located in the chamber, a floating pivot, a slip pivot, and a fixed lobe. The fixed lobe includes a housing end coupled to the housing and a fixed center portion rotatably coupled to the chamber pivot. The mechanism further includes a floating lobe. The floating lobe includes a floating center portion rotatably coupled to the chamber pivot and a floating link end rotatably coupled to the floating pivot. The mechanism further includes a first link. The first link includes a floating end rotatably coupled to the floating pivot and a first pad end rotatably coupled to the slip pivot. The mechanism further includes a second link. The second link includes a fixed end rotatably coupled to the fixed pivot and a second pad end rotatably coupled to the slip pivot. The apparatus includes a pad coupled to the slip pivot and extendable through the slot in the wall upon rotation of the floating lobe with respect to the fixed lobe about the chamber pivot. The mechanism further includes an actuator for rotating the floating lobe with respect to the fixed lobe about the chamber pivot.

Implementations include one or more of the following. The actuator may include a motor coupled to the chamber pivot. The actuator may include a piston coupled between the fixed lobe and the floating lobe. The fixed lobe may further include a fixed end coupled to the fixed lobe. The housing may have a housing height in a height dimension and a housing width in a width dimension that is substantially perpendicular to the height dimension. The housing height may be greater than the housing width. The mechanism may have a mechanism height in the height dimension and a mechanism width in the width dimension. The mechanism width may be greater than the mechanism height.

An apparatus includes a housing. The housing includes a columnar wall, a chamber within the wall, a plurality of slots through the wall, and a center axis about which the columnar wall is symmetrical. The apparatus further includes an axis plane that contains the center axis. The apparatus further includes a plurality of mechanisms. Each of the plurality of mechanisms is aligned with a respective one of the plurality of slots. Each of the plurality of mechanisms comprises a plurality of pivots. Each of the plurality of mechanisms has a respective mechanism plane that intersects at least 3 of the pivots of that mechanism. The plurality of mechanism planes are substantially perpendicular to the axis plane.

Implementations may include one or more of the following. At least one of the plurality of mechanisms may include a fixed pivot coupled to the wall of the housing. At least one of the plurality of mechanisms may further include a chamber pivot located in the chamber. At least one of the plurality of mechanisms may further include a floating pivot, a slip pivot, and a fixed lobe. The fixed lobe may include a housing end coupled to the housing and a fixed center portion rotatably coupled to the chamber pivot. At least one of the plurality of mechanisms may further include a floating lobe. The floating lobe may include a floating center portion rotatably coupled to the chamber pivot and a floating link end rotatably coupled to the floating pivot. At least one of the plurality of mechanisms may further include a first link. The first link may include a floating end rotatably coupled to the floating pivot and a first pad end rotatably coupled to the slip pivot. At least one of the plurality of mechanisms may further include a second link. The second link may include a fixed end rotatably coupled to the fixed pivot and a second pad end rotatably coupled to the slip pivot. At least one of the plurality of mechanisms may further include a pad coupled to the slip pivot and extendable through the respective slot in the wall upon rotation of the floating lobe with respect to the fixed lobe about the chamber pivot. At least one of the plurality of mechanisms may further include an actuator for rotating the floating lobe with respect to the fixed lobe about the chamber pivot.

An apparatus includes a housing. The housing includes a columnar wall, a chamber within the wall, a first slot through the wall, and a second slot through the wall. The apparatus further includes a chamber pivot located in the chamber, a first pivot, a second pivot, a third pivot, a fourth pivot, a first slip pivot, a second slip pivot, and a first lobe. The first lobe includes a first-lobe-first-pivot end rotatably coupled to the first pivot, a first-lobe-center portion rotatably coupled to the chamber pivot, and a first-lobe-fourth pivot end rotatably coupled to the fourth pivot. The apparatus further includes a second lobe. The second lobe includes a second-lobe-second-pivot end rotatably coupled to the second pivot, a second-lobe-center portion rotatably coupled to the chamber pivot, and a second-lobe-third-pivot end rotatably coupled to the third pivot. The apparatus further includes a first link. The first link includes a first-link-third-pivot end rotatably coupled to the third pivot and a first pad end rotatably coupled to the first slip pivot. The apparatus further includes a second link. The second link includes a second-link-fourth-pivot end rotatably coupled to the fourth pivot and a second pad end rotatably coupled to the first slip pivot. The apparatus further includes a third link. The third link includes a third-link-first-pivot end rotatably coupled to the first pivot and a third pad end rotatably coupled to the second slip pivot. The apparatus further includes a fourth link. The fourth link includes a fourth-link-second-pivot end rotatably coupled to the second pivot and a fourth pad end rotatably coupled to the second slip pivot. The apparatus includes a first pad coupled to the first slip pivot and extendable through the first slot in the wall upon rotation of the first lobe with respect to the second lobe about the chamber pivot. The apparatus includes a second pad is coupled to the second slip pivot and extendable through the second slot in the wall upon rotation of the first lobe with respect to the second lobe about the chamber pivot. The apparatus includes an actuator for rotating the first lobe with respect to the second lobe about the chamber pivot.

Implementations may include or more of the following. The actuator may include a motor coupled to the chamber pivot. The actuator may include a piston coupled between the first lobe and the second lobe. The housing may have a housing height in a height dimension and a housing width in a width dimension that is substantially perpendicular to the height dimension. The housing height may be greater than the housing width. The mechanism may have a mechanism height in the height dimension and a mechanism width in the width dimension. The mechanism width is greater than the mechanism height.

An apparatus includes a housing. The housing includes a columnar wall, a chamber within the wall, and a slot through the wall. The apparatus further includes a chamber pivot located in the chamber. The apparatus further includes a scissor link mechanism. The scissor link mechanism includes a first lobe rotatably coupled to the chamber pivot, a second lobe rotatably coupled to the chamber pivot, a pad coupled to the first lobe by a first link and to the second lobe by a second link and extendable through the slot in the wall upon rotation of the first lobe with respect to the second lobe about the chamber pivot.

A method includes fixedly coupling a first lobe to a wall of a housing. The method further includes fixedly coupling a fixed pivot to the first lobe and to the wall of the housing. The method further includes rotatably coupling a chamber pivot to the first lobe. The method further includes rotatably coupling a floating pivot to the chamber pivot. The method further includes rotatably coupling a first link to the floating pivot. The method further includes rotatably coupling a slip pivot to the first link. The method further includes rotatably coupling a second link to the slip pivot and to the fixed pivot. The method further includes coupling a pad to the slip pivot. The method further includes coupling an actuator to the first lobe and to the second lobe.

Implementations may include one or more of the following. Coupling an actuator to the first lobe and to the second lobe may include coupling a piston between the first lobe and the second lobe. Coupling an actuator to the first lobe and to the second lobe may include coupling a motor to the chamber pivot.

A method includes locating a chamber pivot in a chamber in a housing, rotatably coupling a first lobe to the chamber pivot, rotatably coupling a second lobe to the chamber pivot, rotatably coupling a first pivot to the first lobe, rotatably coupling a fourth pivot to the first lobe, rotatably coupling a second pivot to the second lobe, rotatably coupling a third pivot to the second lobe, rotatably coupling a first link to the third pivot and to a first slip pivot, rotatably coupling a second link to the fourth pivot and to the first slip pivot, rotatably coupling a third link to the first pivot and to a second slip pivot, rotatably coupling a fourth link to the second pivot and to the second slip pivot, coupling a first pad to the first slip pivot, coupling a second pad to the second slip pivot, and coupling an actuator to the first lobe and to the second lobe.

Implementations may include one or more of the following. Coupling an actuator to the first lobe and to the second lobe may include coupling a piston between the first lobe and the second lobe. Coupling an actuator to the first lobe and to the second lobe comprises coupling a motor to the chamber pivot.

References in the specification to "one or more embodiments", "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described.

Embodiments include features, methods or processes that may be embodied within machine-executable instructions provided by a machine-readable medium. A computer-readable medium includes any mechanism which provides (i.e., stores and/or transmits) information in a form accessible by a machine (e.g., a computer, a network device, a personal digital assistant, manufacturing tool, any device with a set of one or more processors, etc.). In an exemplary embodiment, a computer-readable medium includes non-transitory volatile and/or non-volatile media (e.g., read only memory (ROM), random access memory (RAM), magnetic disk storage media, optical storage media, flash memory devices, etc.), as well as transitory electrical, optical, acoustical or other form of propagated signals (e.g., carrier waves, infrared signals, digital signals, etc.).

Such instructions are utilized to cause a general or special purpose processor, programmed with the instructions, to perform methods or processes of the embodiments. Alternatively, the features or operations of embodiments are performed by specific hardware components which contain hard-wired logic for performing the operations, or by any combination of programmed data processing components and specific hardware components. One or more embodiments include software, data processing hardware, data processing system-implemented methods, and various processing operations, further described herein.

One or more figures show block diagrams of systems and apparatus for a system for monitoring hookload, in accordance with one or more embodiments. One or more figures show flow diagrams illustrating operations for monitoring hookload, in accordance with one or more embodiments. The operations of the flow diagrams are described with references to the systems/apparatus shown in the block diagrams. However, it should be understood that the operations of the flow diagrams could be performed by embodiments of systems and apparatus other than those discussed with reference to the block diagrams, and embodiments discussed with reference to the systems/apparatus could perform operations different than those discussed with reference to the flow diagrams.

The word "coupled" herein means a direct connection or an indirect connection.

In view of the wide variety of permutations to the embodiments described herein, this detailed description is intended to be illustrative only, and should not be taken as limiting the scope of the invention. What is claimed as the invention, therefore, is all such modifications as may come within the scope and spirit of the following claims and equivalents thereto. Therefore, the specification and drawings are to be regarded in an illustrative rather than a restrictive sense

What is claimed is:

1. An apparatus comprising:

a housing comprising a columnar wall, a chamber within the wall, and a slot through the wall, wherein a circumferential dimension of the slot is greater than a longitudinal dimension of the slot;

a mechanism within the housing, the mechanism comprising:

a fixed pivot coupled to the wall of the housing;

a chamber pivot located in the chamber;

a floating pivot;

a slip pivot;

a fixed lobe comprising:

a housing end coupled to the housing, and a fixed center portion rotatably coupled to the chamber pivot;

a floating lobe comprising:

a floating center portion rotatably coupled to the chamber pivot, and a floating link end rotatably coupled to the floating pivot;

a first link comprising:

a floating end rotatably coupled to the floating pivot, and a first pad end rotatably coupled to the slip pivot;

a second link comprising:

a fixed end rotatably coupled to the fixed pivot, and a second pad end rotatably coupled to the slip pivot;

a pad coupled to the slip pivot and extendable through the slot in the wall upon rotation of the floating lobe with respect to the fixed lobe about the chamber pivot; and an actuator for rotating the floating lobe with respect to the fixed lobe about the chamber pivot.

2. The apparatus of claim 1 wherein the actuator comprises a motor coupled to the chamber pivot.

3. The apparatus of claim 1 wherein the actuator comprises a piston coupled between the fixed lobe and the floating lobe.

4. The apparatus of claim 1 wherein the fixed lobe further comprises a fixed end coupled to the fixed pivot.

5. The apparatus of claim 1 wherein:

the housing has a housing height in a height dimension and a housing width in a width dimension that is substantially perpendicular to the height dimension;

the housing height is greater than the housing width;

the mechanism has a mechanism height in the height dimension and a mechanism width in the width dimension; and the mechanism width is greater than the mechanism height.

6. An apparatus comprising:

a housing comprising a columnar wall, a chamber within the wall, a plurality of longitudinally-separated slots through the wall, and a center axis about which the columnar wall is symmetrical, wherein a circumferential dimension of each of the plurality of longitudinally-separated slots is greater than a respective longitudinal dimension of each of the plurality of longitudinally-separated slots;

an axis plane that contains the center axis;

a plurality of mechanisms, wherein each of the plurality of mechanisms is aligned with a respective one of the plurality of slots, each of the plurality of mechanisms comprises a plurality of pivots, each of the plurality of mechanisms has a respective mechanism plane that intersects at least 3 of the pivots of that mechanism; and wherein the plurality of mechanism planes are substantially perpendicular to the axis plane.

7. The apparatus of claim 6 wherein at least one of the plurality of mechanisms comprises:

a fixed pivot coupled to the wall of the housing;

a chamber pivot located in the chamber;

a floating pivot;

a slip pivot;

a fixed lobe comprising:

a housing end coupled to the housing, and a fixed center portion rotatably coupled to the chamber pivot;

a floating lobe comprising:

a floating center portion rotatably coupled to the chamber pivot, and a floating link end rotatably coupled to the floating pivot;

a first link comprising:

a floating end rotatably coupled to the floating pivot, and a first pad end rotatably coupled to the slip pivot;

a second link comprising:

a fixed end rotatably coupled to the fixed pivot, and a second pad end rotatably coupled to the slip pivot;

a pad coupled to the slip pivot and extendable through the respective slot in the wall upon rotation of the floating lobe with respect to the fixed lobe about the chamber pivot; and an actuator for rotating the floating lobe with respect to the fixed lobe about the chamber pivot.

8. An apparatus comprising:

a housing comprising a columnar wall, a chamber within the wall, and a slot through the wall, wherein a circumferential dimension of the slot is greater than a longitudinal dimension of the slot;

a chamber pivot located in the chamber; and a scissor link mechanism comprising:

a first lobe rotatably coupled to the chamber pivot, a second lobe rotatably coupled to the chamber pivot, and a pad coupled to the first lobe by a first link and to the second lobe by a second link and extendable through the slot in the wall upon rotation of the first lobe with respect to the second lobe about the chamber pivot.

* * * * *